United States Patent [19]

Easter et al.

[11] 4,109,972

[45] Aug. 29, 1978

[54] MOUNTING ASSEMBLY FOR ROLLING MILL GUIDE BOX

[75] Inventors: Holton C. Easter, Munster; Frank F. Matrinetz, Hammond; Ted L. Myers, Chesterton, all of Ind.

[73] Assignee: Inland Steel Company, Chicago, Ill.

[21] Appl. No.: 750,406

[22] Filed: Dec. 14, 1976

[51] Int. Cl.[2] ..... F16C 19/14; F16C 29/00

[52] U.S. Cl. ..... 308/3 R; 308/6 R; 308/174

[58] Field of Search ..... 308/6, 3 R, 3 A, 20, 308/174, 202, 207, 227; 226/196; 72/210, 220, 214, 237, 241, 250; 214/1 QG, 1 R; 100/173, 175, 127, 155 R, 159

[56] References Cited

U.S. PATENT DOCUMENTS

| | | | |
|---|---|---|---|
| 3,632,178 | 1/1972 | Pither | 308/174 |
| 3,832,019 | 8/1974 | Alessi | 308/6 R X |
| 3,837,715 | 9/1974 | Bock | 308/6 R |

OTHER PUBLICATIONS

"Roller Guides for Hot Rolling Mills," Morgardshammar AB of Morgardshammar, Sweden, 1965, pp. 10–27.

*Primary Examiner*—Trygve M. Blix
*Assistant Examiner*—Douglas C. Butler
*Attorney, Agent, or Firm*—Merriam, Marshall & Bicknell

[57] ABSTRACT

Structure is provided for pivotally mounting a box used to guide a bar through the rolls of a rolling mill. The guide box is aligned with a guide bell, and the two are mounted in such a relation that cobble forces transmitted to the guide bell are absorbed by the mounting structure and are not transmitted to the guide box or to the bearings which mount the guide box for pivotal movement. In its operative position, adjacent the rolling mill rolls, the guide box is accessible for adjustment and most maintenance work, and the upstream and downstream ends of the guide box are readily visible. The guide box may be pivoted away from and returned to precisely the same operative position, time after time.

10 Claims, 7 Drawing Figures

MOUNTING ASSEMBLY FOR ROLLING MILL GUIDE BOX

BACKGROUND OF THE INVENTION

The present invention relates generally to guides for bars in bar rolling mills and more particularly to a mounting assembly for a guide box used to guide bars entering or leaving the rolls of a vertical rolling mill.

When a bar undergoes rolling in the rolls of a rolling mill, guide devices are usually provided to guide the bar along a straight linear path portion as the bar enters and leaves the rolls of the rolling mill. Such guide devices may be in the form of a guide box having adjustable rollers to guide the bar, and these guide boxes are generally positioned extremely close to the rolls of the rolling mill.

It is necessary to conduct periodic maintenance and repair on these guide boxes or to make periodic adjustments to the guiding rolls therein. Because of the proximity of the guide box to the rolls of the rolling mill, maintenance and repair were not always convenient, so that structure was provided for moving the guide box away from its operative position, adjacent the rolls of the rolling mill, to a displaced position where the guide box was more accessible and maintenance and repair were more convenient.

Typically, in such an installation, the guide box was mounted for sliding movement toward or away from the rolling mill rolls, but this type of installation had serious drawbacks. For example, the slides on which the guide box was mounted were exposed to water and mill scale from the rolling operation, and this interfered with the movement of the guide box along the slides. When the slides wee not kept clean of water or mill scale, it was difficult to accurately return the guide box to precisely the same position in which it was previously situated before being displaced.

Another drawback to the slidable guide box was that it could bounce up and down on the slides while the bar was moving through the guide box so that the bar was not held rigidly by the guide box as it passed therethrough.

Another prior art installation utilized a stationary trough located immediately upstream of the guide box for guiding the bar into the guide box, but, in this type of installation, the guide box was not readily removable from its operative position so that maintenance and repair were inconvenient.

SUMMARY OF THE INVENTION

The present invention provides a mounting assembly for a guide box which eliminates the drawbacks described above.

The assembly mounts the guide box in such a manner that, even in its operative position, the guide box is accessible from virtually all sides thereof for adjustments and most maintenance and repairs. For other maintenance and repairs, where removal of the guide box from its operative position is desirable, the assembly permits the guide box to be readily moved from its operative position to a displaced position at which access to the guide box for maintenance and repair is even more convenient. In addition, the assembly permits the guide box to be returned to precisely the position it occupied before displacement.

Problems with mill scale or water accumulating on slides or the like are eliminated. The mounting assembly utilizes bearings which are fully enclosed and protected from water and mill scale.

In its operative position, both the upstream and downstream ends of the guide box are readily visible so that guide roller wear or breakage at the downstream or roller end of the guide box can be determined and so that one can observe if entry to the guide box is obstructed by a piece of jammed bar or if there is "steel pick up," i.e., steel rubbed off from the bar passing through the guide box. In such situations, the entry or upstream end of the guide box must be cleaned out.

Another advantage of the present mounting assembly is that, if a cobble were to occur (i.e., an entanglement of the bar upstream of the guide box) the forces emanating from the cobble in a downstream direction are not transmitted to the guide box or to the bearings on which the assembly are mounted for movement, but, rather, are absorbed by other structure in the mounting assembly to protect the guide box and the bearings from the effect of the cobble force.

Other features and advantages are inherent in the structure claimed and disclosed or will become apparent to those skilled in the art from the following detailed description in conjunction with the diagrammatic drawings.

DETAILED DESCRIPTION

Figure 3:
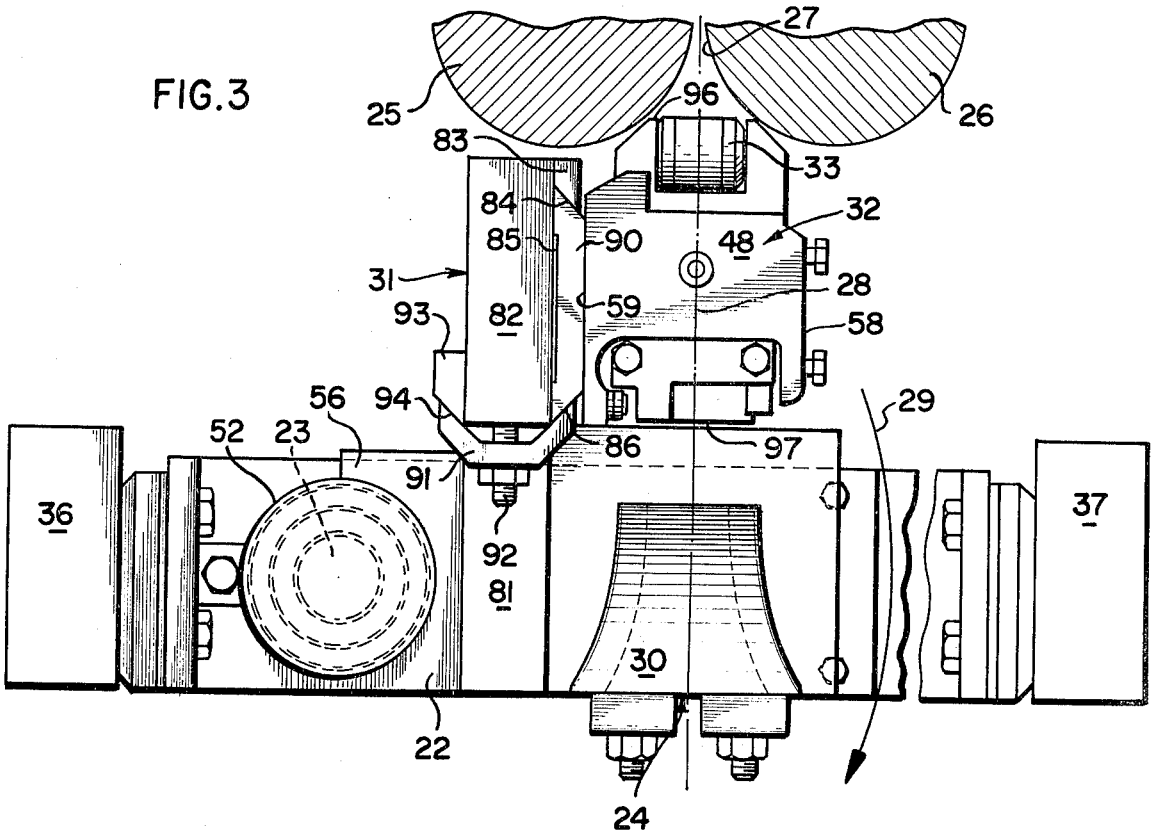
FIG. 3 is a plan view of the mounting assembly.
Figure 4:
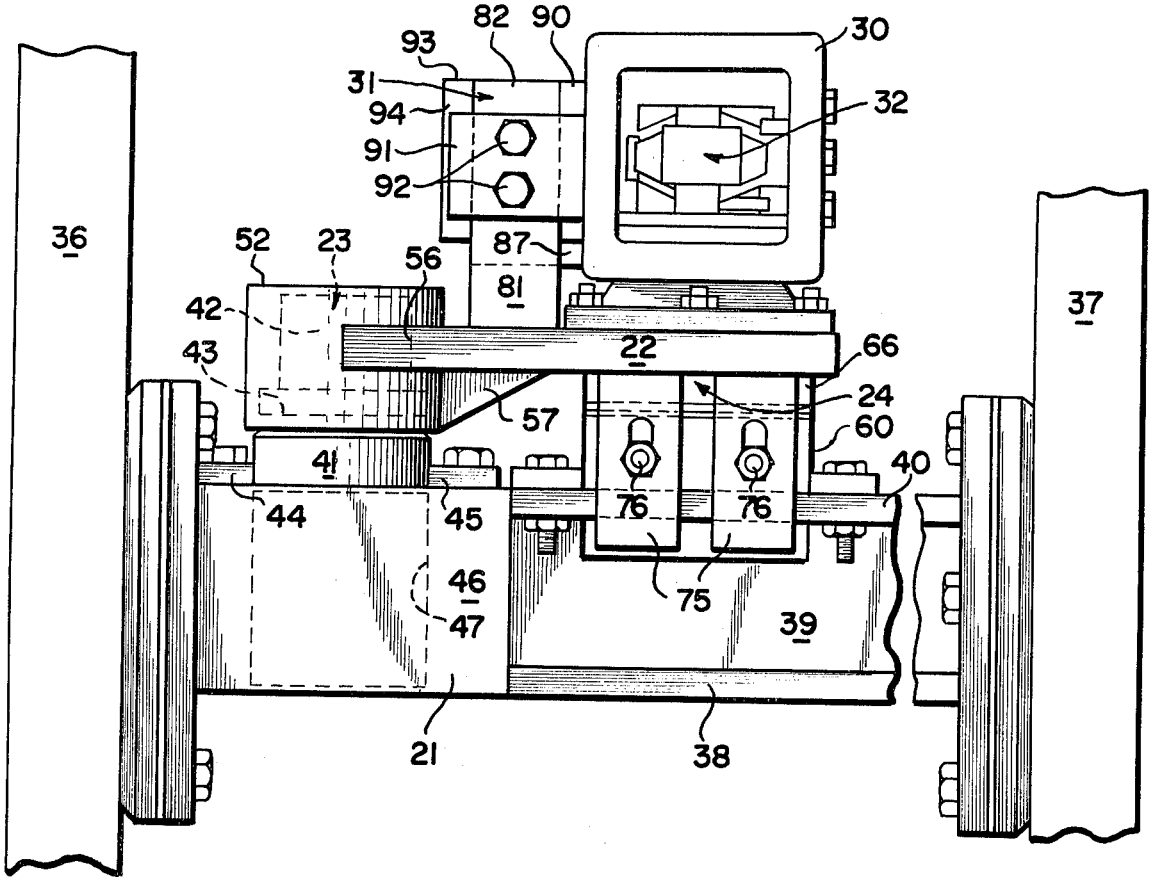
FIG. 4 is an end view of the mounting assembly from an upstream direction.
Figure 6:
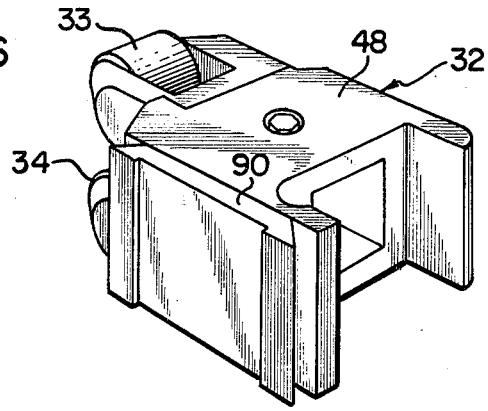
FIG. 6 is a perspective of an embodiment of a guide box with which the mounting assembly is used.
Figure 5:
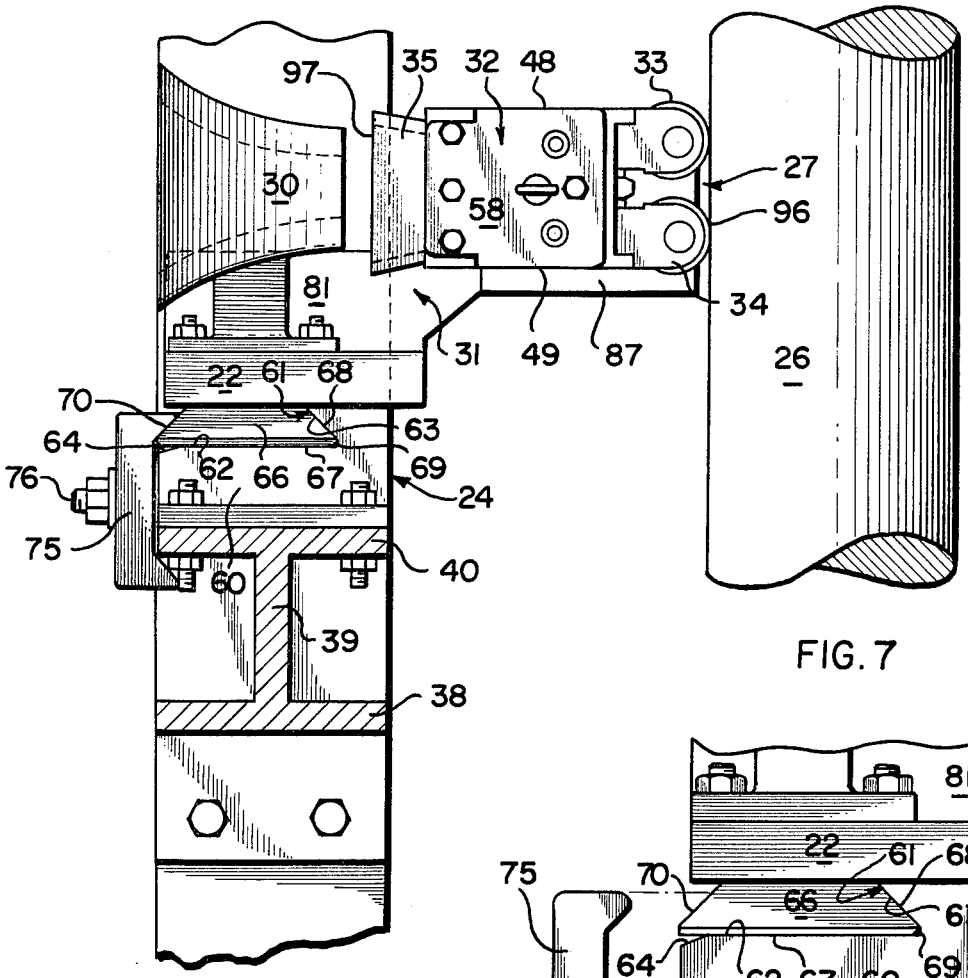
FIG. 5 is a side elevational view of the mounting assembly, partially in section.
Figure 7:
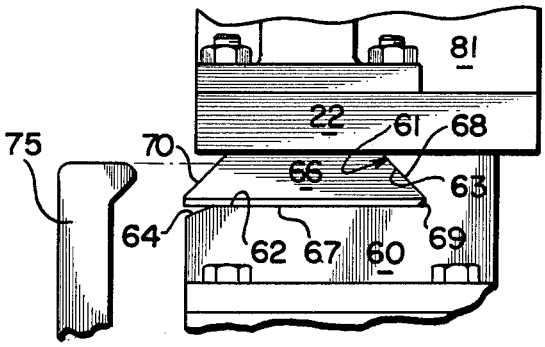
FIG. 7 is an enlarged, fragmentary, side elevational view of a portion of the mounting assembly.

Referring to the figures, the mounting assembly comprises a base 21 and a horizontally disposed bridge member 22 located above base 21. Mounted on base 21 is a vertical pivot pin or shaft 23 which in turn mounts bridge member 22 for pivotal movement about the vertical pivotal axis of pivot pin 23, between first and second positions of the bridge member. The first position is illustrated in FIGS. 3–5, and determines the operative position for the guide box and the rest of the mounting assembly. The second position is pivotally displaced from the first position, in the direction of arrow 29 in FIG. 3 (clockwise to the left), a substantial amount (e.g., 90°) and determines the displaced position for the guide box and mounting assembly. Pivot pin 23 and bridge member 22 are supported on base 21 at a first support location adjacent the vertical pivotal axis of the bridge member. The details of the supporting structure will be subsequently described.

Situated on base 21 at 24 is additional structure, to be described subsequently in detail, for supporting bridge member 22 at a second location on base 21 remote from the vertical pivotal axis of bridge member 22. Bridge member 22 is supported at second location 24 on base 21 when the bridge member is in its operative position (FIGS. 3–5), but not, of course, when bridge member 22 is in its displaced position.

Mounted on bridge member 22 is a guide element or bell 30, located directly over second supporting location 24 when the bridge member is in its second position. Also located on bridge member 22, at a third location, between the first and second support locations is mounting structure 31 for removably mounting a roller guide box 32 on bridge member 22.

Guide box 32 is of conventional construction with guide rollers 33, 34 at its downstream end 96. Guide box 32 has adjusting screws on its top and bottom surfaces 48, 49 and on opposite side surfaces 58, 59. The embodiment of guide box illustrated in FIG. 5 is shown with an entry portion 35 flared outwardly in an upstream direction.

When bridge member 22 is in its operative position (FIGS. 3–5), guide bell 30 and roller guide box 32 are aligned with the nip 27 of a pair of vertical rolls 25, 26 of a rolling mill for rolling a bar. During the rolling operation the bar proceeds along a straight linear path portion (dash-dot line 28 in FIG. 3) which extends through guide bell 30, roller guide box 32 and nip 27 between vertical rolls 25, 26.

Using the bar's straight linear path portion 28 as a reference, it can be seen from FIG. 3 that the second support location 24 is spaced from the first support location, (adjacent the axis of vertical pivot pin 23) in a direction transverse to the direction of the straight linear path portion.

There will now be described the details of the structure for supporting bridge member 22 at a first location on base 21 adjacent the vertical pivotal axis of the base, and this description includes the details of the pivotal mounting structure for the assembly.

Figure 1:
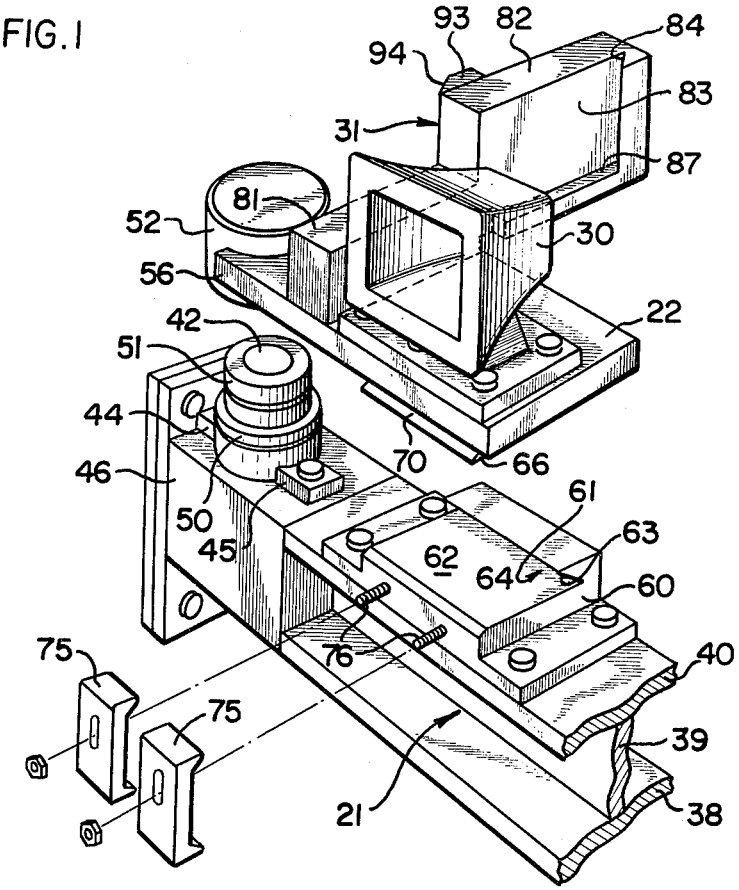
FIG. 1 is an exploded perspective of an embodiment of a mounting assembly constructed in accordance with the present invention.
Figure 2:
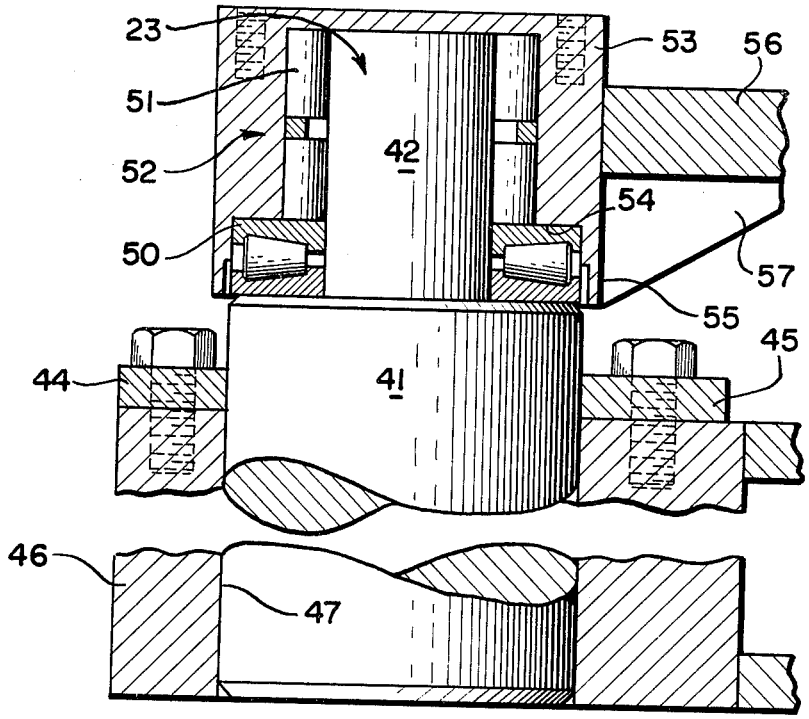
FIG. 2 is an enlarged vertical sectional view showing a portion of the mounting assembly.

Base 21 is bolted to a pair of vertically disposed stanchions 36, 37 and comprises a lower flange 38, a web 39 and an upper flange 40. As shown in FIG. 2, pivot pin 23 comprises a lower portion 41 with a relatively wide diameter and an upper portion 42 axially aligned with lower portion 41 and having a relatively narrow diameter. Pivot pin 23 also comprises a flat, horizontal shoulder portion 43 where upper portion 42 joins lower portion 41. Extending outwardly from lower portion 41 are a pair of ears 44, 45 supported on and bolted to an end portion 46 on base 21. End portion 46 has a cylindrical opening 47 for receiving lower pivot pin portion 41.

Resting on the pivot pin's shoulder portion 43 is a thrust bearing 50 disposed around upper portion 42 of the pivot pin. Located around the pivot pin's upper portion 42, above thrust bearing 50, are roller bearings 51 disposed in rolling relation to upper portion 42.

A housing 52 encloses thrust bearing 50, roller bearings 51 and upper portion 42 of the pivot pin. Housing 52 comprises an upper cylindrical portion 53, providing the outer race for rolling bearings 51, and a lower interior portion 54 resting on thrust bearing 50. Depending from upper cylindrical portion 53 is a skirt portion 55. Housing 52 constitutes protective enclosure means covering thrust bearing 50 and roller bearings 51 to protect them against the entry of foreign matter.

Attached to housing 52 is an end portion 56 of bridge member 22, and located beneath bridge member 22 at its end portion 56 is a brace 57 which helps support the bridge member.

When bridge member 22 is in its operative position, thrust bearing 50, and to a lesser extent roller bearings 51, carries the weight of the bridge member and maintains the elevation of the bridge member at one end thereof. After the bridge member has been pivoted from its operative to its displaced position for inspection or maintenance of the guide box, roller bearings 51 provide the accuracy required to return the bridge member, and the guide bell 30 and roller guide box 32 mounted thereon, to precisely the same position they occupied before they were pivoted away from the operative position. The roller bearings need only be lubricated once every several months, for example, and thus may be sealed inside housing 52. A bushing would be difficult to seal. The sealed roller bearings do not wear out like a bushing would.

There will now be described the details of the structure for supporting bridge member 22 at second location 24 on base 21. Bolted on base 22 at second support location 24 is a lower rest bar 60 having a horizontally disposed female dovetail 61 (FIG. 5) comprising a flat bottom surface 62, an inclined forward or inner surface 63 and a tapered rear or outer edge 64. The horizontally disposed female dovetail 61 receives a horizontally disposed male dovetail 66 attached to the bottom of bridge member 22. Male dovetail 66 comprises a flat bottom surface 67, an inclined forward or inner surface 68 with a chamfered leading edge 69 and an inclined rear surface 70. Tapered outer edge 64 on female dovetail 61 cooperates with chamfered leading edge 69 on male dovetail 66 to facilitate entry of male dovetail 66 into female dovetail 60, when bridge member 22 is pivoted from its displaced to its operative position.

Bridge member 22 is held in its operative position, supported by base 21 at second supporting location 24, by a plurality of clamps 75 engaging male dovetail 66 and base 21. Clamps 75 are held in place by bolts 76 extending through lower rest bar 60. To move bridge member 22, guide bell 30 and roller guide box 32 from their operative positions to their displaced positions, one need merely loosen the nuts on bolts 76, in turn enabling clamps 75 to be loosened from their engagement with male dovetail 66 and base 21. Once the clamps are loosened, they may be dropped out of the way, and bridge member 22 may be pivoted about the axis of pivot pin 23 to its displaced position.

As previously mentioned, roller guide box 32 is removably mounted on bridge member 22 by structure indicated generally at 31 and located at a third support location situated between pivot pin 23 and second support location 24. Mounting structure 31 comprises a first portion 81 located atop and integral with bridge member 22 and a second portion 82 cantilevered forwardly from and extending upwardly relative to first portion 81 and bridge member 22. Second portion 82 is cantilevered in the direction of rolling mill rolls 25, 26 when the bridge member 22 is in its operative position.

Located on one side of cantilevered portion 82 (to the right in FIG. 3) is a female dovetail 83 comprising an inwardly inclined rear surface 84 and having an open upper end 85 and an open forward end 86. Located at the bottom of female dovetail 83 is a rest portion 87 for supporting a male dovetail 90 located on a side of roller guide box 32 adjacent cantilevered mounting portion 82 and constituting a mounting element for the roller guide box. Male dovetail 90 is received in female dovetail 83 from above and rests upon bottom rest portion 87.

Male dovetail 90 is held in place in female dovetail 83 by a clamp 91 in turn held in place by bolts 92 extending through cantilevered mounting portion 82. Clamp 91 also engages a tapered surface 94 on a wing 93 extending outwardly (to the left in FIG. 3) from cantilevered portion 82.

Mounting structure 31 and its constituent parts 81–87 and 90–94 constitute structure for mounting portion 82 in cantilevered relation to bridge member 22 and for mounting guide box 32 in cantilevered relation to portion 82. As thus mounted, guide box 32 extends from cantilevered portion 82 in a direction transverse to straight linear path portion 28 of the bar undergoing rolling, when bridge member 22 is in its operative position.

Because guide box 32 is mounted in the manner described above, the guide box is readily accessible for maintenance, repairs and adjustments. In addition, the downstream and upstream ends of the guide box, 96, 97 respectively, are readily visible, an important factor from the standpoint of effecting timely cleaning of the front and back ends to prevent breakdowns of the roller guide box.

As previously noted, roller guide box 32 is separate and discrete from guide bell 30, the latter being mounted on bridge member 22 directly above second mounting location 24. In addition, roller guide box 32 is cantilevered from its supporting structure 31 in turn cantilevered from bridge member 22 at a location between the first and second supporting locations for the bridge member. Moreover, the bearings, which mount the assembly for pivotal movement about the axis of pivot pin 23, are separated from guide bell 30 by the length of bridge member 22.

Because of the locations and mounting relationships described in the preceding paragraph, guide box 32, and the pivotal mounting for the bridge member at pivot pin 23, are protected from subjection to the forces arising when there is a cobble or entanglement, upstream of rolls 25, 26, of the bar undergoing rolling. The force transmitted from the cobble is transmitted directly to guide bell 30 and from there to the supporting structure located beneath guide bell 30 at second supporting location 24, and this supporting structure absorbs the force from the cobble. More specifically, any cobble force transmitted to guide bell 30 is in turn transmitted through the dovetail mounting, 63, 66 to the lower rest bar 60 on base 21 or, to the extent it is transmitted along bridge member 22 to upper rest bar 31, the force is absorbed by upper rest bar 31 without being transmitted to roller guide box 32 or being transmitted further through bridge member 22 to the bearings at pivot pin 23.

As previously mentioned, bridge member 22 may be pivoted from its operative position (FIGS. 3–5) to a displaced or maintenance position in which there is complete access to roller guide box 32. In the maintenance position, the guide box may be removed from its mounting on bridge member 22 merely by disengaging clamp 91 and lifting guide box 32 thereby removing the guide box and its mounting element (male dovetail 90) from engagement with female dovetail 83 on mounting element 31.

After the guide box 32 has undergone whatever inspection or maintenance as is desired, it is returned to (or retained in) a mounting disposition on mounting element 31. The bridge member is then pivoted back to its operative position. As noted above, when this occurs, the guide box returns to precisely the same position it occupied before the bridge member was pivoted away from its operative position. The guide box can be repeatedly pivoted from and returned to precisely the same position because there is virtually no wear on bearings 50, 51. Protective housing 53 protects the bearings against the entry of foreign matter which could have an adverse effect upon these bearings.

As previously indicated, thrust bearing 50, and to a lesser extent roller bearings 51, carries the weight of the mounting assembly during pivotal movement thereof. When bridge member 22 is in its operative position, it is maintained at a desired, previously determined elevation by thrust bearing 50 (at the first supporting location adjacent pivot pin 23) and by the dovetail mounting 63, 66 at second supporting location 24.

Bridge member 22 can be manually pivoted between its two positions or can be power driven by conventional structure, not shown, which may be attached to the top of housing 52 to rotate, about pivot pin 23, with the housing, bridge member 22 and all elements attached thereto.

The foregoing detailed description has been given for clearness of understanding only, and no unnecessary limitations should be understood therefrom, as modifications will be obvious to those skilled in the art.

What is claimed is:

1. A mounting assembly for a guide box in a bar-rolling mill including rolling mill rolls wherein a bar moves along a straight, linear path portion through said guide box and the rolling mill rolls, said mounting assembly comprising:

a base;

a horizontally disposed bridge member located above said base;

means mounting said bridge member for pivotal movement about a vertical pivotal axis, between an operative position and a position displaced from said operative position;

means on said base for supporting said bridge member at a first location on the latter adjacent said vertical pivotal axis thereof;

means on said base for supporting said bridge member, at a second location thereon remote from its vertical pivotal axis, when the bridge member is in its operative position;

said second location being spaced from said first location in a direction transverse to the direction of said straight linear path portion;

first disengageable means for engaging said bridge member when the latter is in its operative position and for securely holding it there;

means, at a third location on said bridge member, for removably mounting said guide box on the bridge member;

and second disengageable means for engaging said guide box when the latter is mounted on the bridge member and for securely holding the guide box there.

2. A mounting assembly as recited in claim 1 and comprising:

a guide element separate and discrete from said guide box;

and means mounting said guide element on said bridge member directly above said second location thereon;

said last recited mounting means comprising means positioning said guide element adjacent to and horizontally aligned with said guide box, along said straight linear path portion, when the guide box is mounted on the bridge member and the latter is in its operative position.

3. A mounting assembly as recited in claim 2 wherein:

said third location on the bridge member is between said first and second locations thereon;

and said removable mounting means for the guide box comprises means for mounting said guide box in a cantilevered disposition relative to said bridge member.

4. A mounting assembly as recited in claim 3 wherein said removable mounting means comprises:

a portion cantilevered from said bridge member in a direction toward said rolling mill rolls when the bridge member is in its operative position;

and means for mounting said guide box in cantilevered relation to said cantilevered portion, with the guide box extending from said cantilevered portion in a direction transverse to said straight linear path portion, when the bridge member is in its operative position.

5. A mounting assembly as recited in claim 1 wherein said removable mounting means comprises:

a portion cantilevered from said bridge member in a direction toward said rolling mill rolls when the bridge member is in its operative position;

and means for mounting said guide box in cantilevered relation to said cantilevered portion, with the guide box extending from said cantilevered portion in a direction transverse to said straight linear path portion, when the bridge member is in its operative position.

6. A mounting assembly as recited in claim 1 wherein:

said pivotal mounting means comprises roller bearing means;

and said supporting means at said first location of the bridge member comprises thrust bearing means.

7. A mounting assembly as recited in claim 6 and comprising:

protective enclosure means covering both of said bearing means to protect them against the entry of foreign matter.

8. A mounting assembly as recited in claim 6 and comprising:

a vertical pivot pin having an axis corresponding to said vertical pivotal axis;

means mounting said vertical pivot pin on said base;

said vertical pivot pin having a lower portion with a relatively wide diameter and an upper portion axially aligned with said lower portion and having a relatively narrow diameter;

a flat, horizontal shoulder portion on the pivot pin where the upper portion thereof joins the lower portion;

said thrust bearing means resting on said shoulder portion, around said upper portion of the pivot pin;

said roller bearing means being disposed around said upper portion of the pivot pin, above said thrust bearing means, in rolling relation to said upper portion;

a housing enclosing said thrust bearing means, said roller bearing means and the upper portion of said pivot pin, said housing providing the outer race for said roller bearing means;

said housing having an interior portion resting on said thrust bearing means;

and means fixing said bridge member to said housing.

9. A mounting assembly as recited in claim 1 wherein said supporting means at the second location comprises:

horizontally disposed male dovetail means on said bridge member;

horizontally disposed female dovetail means on said base for receiving said male dovetail means;

a chamfered leading edge on said male dovetail means;

and a tapered outer edge on said female dovetail means for cooperating with said chamfered leading edge to facilitate entry of the male dovetail means into the female dovetail means;

said first disengageable means comprising clamp means for clamping said male dovetail means to said base when the male dovetail means is received in the female dovetail means.

10. A mounting assembly as recited in claim 1 wherein said means for removably mounting said guide box comprises:

a first mounting element on one side of said guide box;

a second mounting element on the bridge member;

vertically disposed male dovetail means on said first mounting element;

and vertically disposed female dovetail means on said second mounting element for receiving said male dovetail means;

said female dovetail means having an open upper end for receiving the male dovetail means from above;

said second mounting element comprising means, at the bottom of said female dovetail means, for supporting said male dovetail means;

said second disengageable means comprising clamp means for clamping said second mounting element to said first mounting element when the male dovetail means is received in the female dovetail means.

* * * * *